US005330963A

United States Patent [19]

Ikemoto et al.

[11] Patent Number: 5,330,963

[45] Date of Patent: Jul. 19, 1994

[54] TRANSFER PRINTING METHOD

[75] Inventors: Manabu Ikemoto; Hitomi Kawabata, both of Osaka, Japan

[73] Assignee: Fujicopian Company, Ltd., Osaka, Japan

[21] Appl. No.: 35,317

[22] Filed: Mar. 22, 1993

[30] Foreign Application Priority Data

Mar. 25, 1992 [JP] Japan ..... 4-067166

[51] Int. Cl.[5] ..... B41M 5/035; B41M 5/38

[52] U.S. Cl. ..... 503/227; 156/235; 156/239; 156/240; 428/195; 428/913; 428/914

[58] Field of Search ..... 8/471; 156/235, 239, 156/240; 428/195, 913, 914; 503/227

[56] References Cited

FOREIGN PATENT DOCUMENTS 57-102390 6/1982 Japan .

*Primary Examiner*—B. Hamilton Hess

*Attorney, Agent, or Firm*—Adduci, Mastriani, Schaumberg & Schill

[57] ABSTRACT

Disclosed is a transfer printing method including the steps of: with use of a thermal transfer ink sheet wherein a heat-meltable ink Y containing a sublimation dye for yellow, a heat-meltable ink sublimation M containing a dye for magenta and a heat-meltable ink C containing a sublimation dye for cyan are applied on a single foundation or separate foundations respectively, selectively melt-transferring at least two of the sublimation inks Y, M and C onto a master sheet to form a master image in which at least two of respective images of the sublimation inks Y, M and C are superimposed one on the other; and transferring the sublimation dyes contained in the superimposed images onto an image receptor, wherein the sublimation inks Y, M and C are transferred onto the master sheet in the order of ink C, ink M and ink Y with an optional skipping-over of untransferred sublimation ink to the succeeding one. With this method a color dyed image can be obtained with a good color reproducibility, especially for an achromatic color.

1 Claim, 8 Drawing Sheets

EMBODIMENT A

EMBODIMENT B

TRANSFER PRINTING METHOD

BACKGROUND OF THE INVENTION

The present invention relates to a transfer printing method wherein with utilization of a thermal transfer technique a master image containing a sublimation dye is formed, and then the sublimation dye in the master image is transferred onto an image receptor such as textile goods to form a dyed image thereon.

There is a transfer printing method using a sublimation dye as one of the methods of forming dyed images on textile goods. According to this method, generally, a transfer paper sheet wherein an image is printed on a sheet of paper with a printing ink containing a sublimation dye is formed first, then pressed against a textile article, followed by heating to give a dyed image thereon. Such a method, however, needs to fabricate a form for forming the transfer paper sheet and is, hence, suitable for mass production but unsuitable for production of diversified items each in an small amount.

On the other hand, there is a method of the type wherein with use of a thermal transfer ink sheet provided on a foundation with a non-transferable resin layer containing a sublimation dye, an image is printed on an image receptor such as a paper sheet with a thermal transfer printer. Such a method will be referred to as "direct transfer method" hereinafter. This method, although suitable for production of diversified items each in a small amount, has a difficulty in obtaining a clear dyed image if an image receptor is of textile because the heating energy produced by a thermal head of a typical thermal transfer printer is not so large.

As a method which overcomes the drawbacks of the above two method wherein with use of a thermal transfer ink sheet provided on a foundation with a heat-meltable ink layer containing a sublimation dye, the ink layer is selectively melt-transferred onto a master sheet such as made of paper with a thermal transfer printer to form a master having an image of heat-meltable ink containing the sublimation dye, and then this master is pressed against a textile article and heated to cause the sublimation dye therein to transfer onto the textile article, thereby obtaining a dyed image (refer to Japanese Unexamined Patent Publication No. 102390/1982). With such a method a dyed image of a desired design can be readily obtained as compared with the foregoing transfer printing method since a master can be formed with a thermal transfer printer, and a clearer dyed image can be obtained on a textile article as compared with one obtained by the foregoing direct transfer method since the transfer from the master can be achieved with a hot press or the like.

With the transfer printing method disclosed in the above publication, however, merely a monochromatic dyed image is obtained from a single master. Recently, there has been a strong desire to obtain a polychromatic dyed image from a single master in accordance with this transfer printing method.

An attempt has been made by the present inventors to obtaining a polychromatic image from a single master by using a thermal transfer ink sheet wherein applied on a foundation are a heat-meltable ink Y containing an yellow sublimation dye, heat-meltable ink M containing a magenta sublimation dye and heat-meltable ink C containing a cyan sublimation dye, sequentially selective-transferring these inks onto a master sheet to form a master image in which the inks are superimposed one on the other, and pressing this master image against a textile article while heating to cause the sublimation dyes in the master image to transfer onto the textile article.

By the way, a thermal transfer color printer which is commercially available at present uses a thermal transfer ink sheet wherein on a single foundation or a plurality of foundations are applied a heat-meltable transparent ink layer Y containing an yellow pigment, heat-meltable transparent ink layer M containing a magenta pigment and heat-meltable transparent ink layer C containing a cyan pigment, and is adapted to form a polychromatic image in accordance with the subtractive color mixture of yellow, magenta and cyan by sequentially transferring these transparent inks onto an image receptor such as made of paper to form a printed image in which the transparent inks for respective colors are superimposed one on the other. With this printer, for example, red is obtained by superimposing the yellow and magenta inks on each other, green by the yellow and cyan inks, blue by the magenta and cyan inks, and black by the yellow, magenta and cyan inks.

It is known that in obtaining a color other than the three primary colors by superimposing transparent inks of the primary colors the color reproducibility depends on the order of superimposition, and that the superimposition of yellow, magenta and cyan ink layers in this order from an image receptor offers the best color reproducibility. For this reason the thermal transfer color printer is designed to transfer the inks for respective colors in that order.

Accordingly, in the case of the thermal transfer ink sheet provided on a single foundation with the transparent inks for respective colors, the yellow ink Y, magenta ink M and cyan ink C are arranged in the order of Y, M and C in the direction opposite to the ribbon-feeding direction (indicated by an arrow) as shown in FIG. 9. The arrangement of Y, M and C constitutes a pattern P which is repeatedly provided on the foundation. Correspondingly the thermal transfer color printer is designed to transfer the inks for respective colors in the order of Y→M→C (which means that Y is transferred first, M second and C third).

If the thermal transfer color printer is employed to form the aforesaid master for transfer printing, the inks respectively containing sublimation dyes in the thermal transfer ink sheet for forming the master are arranged in the same order as in the thermal transfer ink sheet for superimposing transparent inks, and transferred in the order of Y→M→C. In the master image formed in this manner, Y, M and C are superimposed in this order on the master sheet.

However, it has been found that transfer printing on a textile article with use of such a master cannot offer a satisfactory color reproducibility.

It is an object of the present invention to improve the color reproducibility offered by a transfer printing method wherein a master is formed by superimposing inks containing sublimation dyes for respective colors by means of thermal transfer and a polychromatic dyed image is obtained by transferring the sublimation dyes from the master onto a textile article.

This and other object will become apparent from the description hereinafter.

SUMMARY OF THE INVENTION

According to the present invention, there is provided a transfer printing method including the steps of: with use of a thermal transfer ink sheet wherein a heat-meltable sublimation ink layer Y containing a sublimation dye for yellow, a heat-meltable sublimation ink layer M containing a sublimation dye for magenta and a heat-meltable sublimation ink layer C containing a sublimation dye for cyan are applied on a single foundation or thermal transfer ink sheets wherein a heat-meltable sublimation ink layer Y containing a sublimation dye for yellow, a heat-meltable sublimation ink layer M containing a sublimation dye for magenta and a heat-meltable sublimation ink layer C containing a sublimation dye for cyan are applied on separate foundations respectively, selectively melt-transferring at least two of the sublimation inks Y, M and C onto a master sheet to form a master image in which at least two of respective images of the sublimation inks Y, M and C are superimposed one on the other; and transferring the sublimation dyes contained in the superimposed images onto an image receptor, wherein the sublimation inks Y, M and C are transferred onto the master sheet in the order of from the ink C through the ink M to the ink Y with an optional skipping-over of untransferred sublimation ink to the succeeding one.

The present invention preferably uses as the thermal transfer ink sheet a thermal transfer ink sheet I wherein the sublimation inks Y, M and C are arranged on the single foundation in the order of from the sublimation ink C through the sublimation ink M to the sublimation ink Y in a direction opposite to a direction in which the thermal transfer ink sheet is to be fed, and that order is periodically repeated.

In forming the master image on the master sheet, a thermal transfer printer is preferably used which is adapted to use a thermal transfer ink sheet II wherein a yellow ink Y, a magenta ink M and a cyan ink C are periodically arranged in this order on a single foundation in a direction opposite to a feeding direction of the thermal transfer ink sheet II while at the same time detection marks Sy, Sm and Sc are provided for the inks Y, M and C, respectively, and which is constructed so as to select the inks for desired colors by detecting the detection marks with a detection means on condition that the thermal transfer ink sheet II is moved only in the feeding direction and to transfer the inks Y, M and C in this order; and with use of an ink sheet wherein the sublimation inks C, M and Y are provided in this order as in the thermal transfer ink sheet I and the detection marks Sy, Sm and Sc as in the thermal transfer ink sheet II are also provided for the sublimation inks C, M and Y, respectively, the sublimation inks C, M and Y are transferred onto the master sheet in this order by selecting and transferring the sublimation ink C upon detection of the detection mark Sy, the sublimation ink M upon detection of the detection mark Sm, and the sublimation ink Y upon detection of the detection mark Sc, by the detection means.

DETAILED DESCRIPTION

Figure 1:
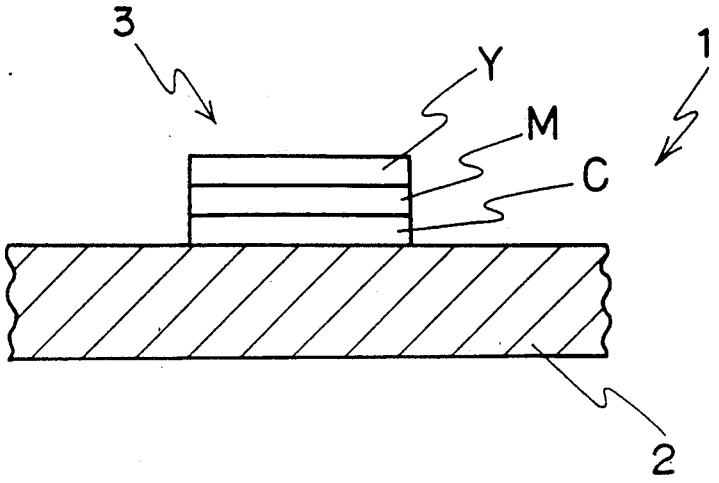
FIG. 1 is a schematic explanatory view showing the order of superimposition of sublimation inks Y, M and C on a master obtained according to the method of the present invention.

In the present invention, as shown in FIG. 1, transferred onto a master sheet 2 are a heat-meltable sublimation ink containing a cyan sublimation dye (hereinafter sometimes referred to as "sublimation ink C"), a heat-meltable sublimation ink containing a magenta sublimation dye (hereinafter sometimes referred to as "sublimation ink M") and a heat-meltable sublimation ink containing a yellow sublimation dye (hereinafter sometimes referred to as "sublimation ink Y) in this order, to form a master 1 having a master image 3 in which the sublimation inks C, M and Y are superimposed one on the other in this order on the master sheet 2.

Figure 2:
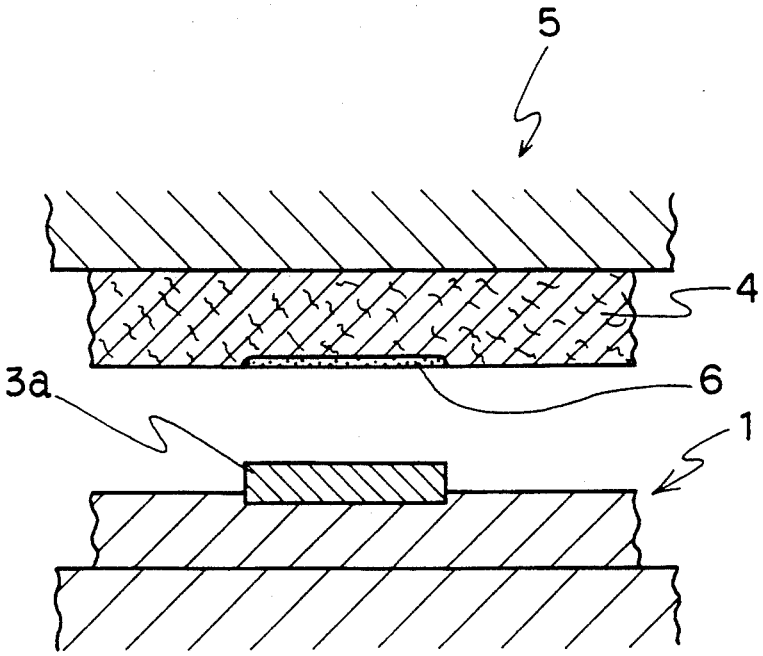
FIG. 2 is a schematic explanatory view for illustrating a transfer printing step according to the method of the present invention.

The master 1 thus formed is placed on an image receptor 4 such as a textile article so that the master image 3 would face opposite the image receptor 4 and pressed thereagainst while heating with a hot press 5. As a result, the dyes for respective colors in the master image 3 are transferred onto the image receptor 4 by diffusion, sublimation or a like phenomenon, and the tissue of the image receptor is dyed thereby to form a dyed image 6. In FIG. 2 numeral 3*a* denotes a residue of the master image 3 (residual material remaining after the sublimation dyes have been transferred).

In the present invention it has been found that a dyed image with a good color reproducibility can be obtained when the dyes are transferred from the master image 3 in which the sublimation inks C, M and Y are superimposed one on the other in this order on the master sheet 2 as shown in FIG. 1. Although the reason therefor is not specified yet, it is presumed that when the sublimation dyes are transferred from the master image, the textile article is dyed with the yellow sublimation dye, magenta sublimation dye and cyan sublimation dye substantially in this order, and this dying order serves to improve the color reproducibility.

According to the present invention, there are the following combinations as the transfer order of the sublimation inks Y, M and C onto the master sheet. It should be noted that in the right column are noted colors obtained from such combinations, respectively.

(1) M→Y: reddish color (R)
(2) C→Y: greenish color (G)
(3) C→M: bluish color (B)
(4) C→M→Y: blackish color (BL).

With any of the above combinations, the color reproducibility is recognized to be improved, and with the combination (4) in particular, such an improvement is remarkable. That is, when a black or gray dyed image is formed from a master obtained in the transfer order of Y→M→C, yellowish black or gray, for example, is obtained and, hence, a completely achromatic color cannot be obtained. According to the present invention, in contrast, substantially a complete achromatic color can be obtained.

To be described next is a process for fabricating a master by transferring the sublimation inks in the order of C→M→Y. It should be noted that in the present invention a conventional-type thermal transfer color printer is used with minimum modifications, for example, only the software for the printer is modified without modifications of the mechanism of the printer itself.

Described first is a process for fabricating a master with use of a conventional thermal transfer color printer which is designed to form color images using a conventional thermal transfer ink sheet in which transparent inks Y, M, C are arranged in this order on a single foundation.

First the construction of a conventional thermal transfer color printer will be explained.

Figure 8:
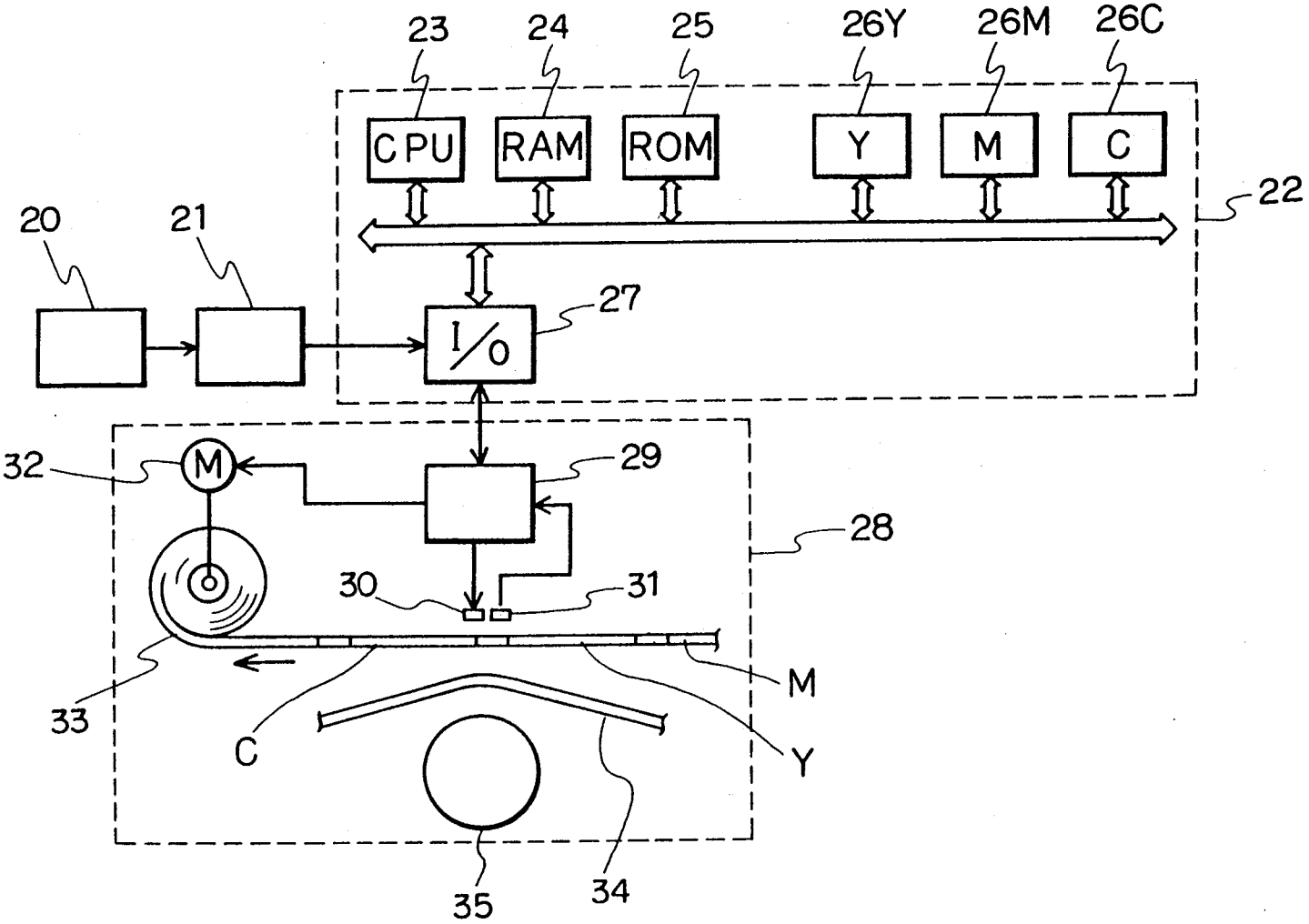
FIG. 8 is a schematic explanatory view for illustrating the configuration of an example of thermal transfer printer.

The configuration of such a conventional thermal transfer printer is schematically shown in FIG. 8. Numeral 21 denotes a color scanner which scans a color original document 20 and inputs RGB signals resulting from the scanning to a system part 22. The system part 22 comprises a central processing unit 23, random access memory (RAM) 24, read only memory (ROM) 25, frame memory portions 26Y, 26M and 26C for respectively storing a yellow signal, magenta signal and cyan signal, and an I/O interface 27. The RGB signals fed from the color scanner 21 are converted into YMC signals through the I/O interface 27 and stored in the frame memory portions 26Y, 26M and 26C, respectively. In the ROM 25 is stored a program for controlling the system. A printer part 28 comprises a control unit 29 having a built-in microcomputer, a thermal head 30, sensor 31 for detecting detection marks provided in the ink sheet, ink sheet-driving device 32 and platen 35. It should be noted that as the source of color image signals, besides output signals of the color scanner, output signals of a computer, word processor, CAD system or the like can be utilized.

The program stored in the ROM 25 of the system part 22 is adapted to feed color signals stored respectively in the frame memory portions 26Y, 26M and 26C to the printer part 28 in the order of Y→M→C. Specifically, the colors to be transferred and the order thereof which correspond to the colors of the original document are determined as in Table 1.

TABLE 1

| Color of original document | Colors to be transferred and order of transfer |
|---|---|
| Y | Y |
| M | M |
| C | C |
| R | Y → M |
| G | Y → C |
| B | M → C |
| BL | Y → M → C |

Figure 10:
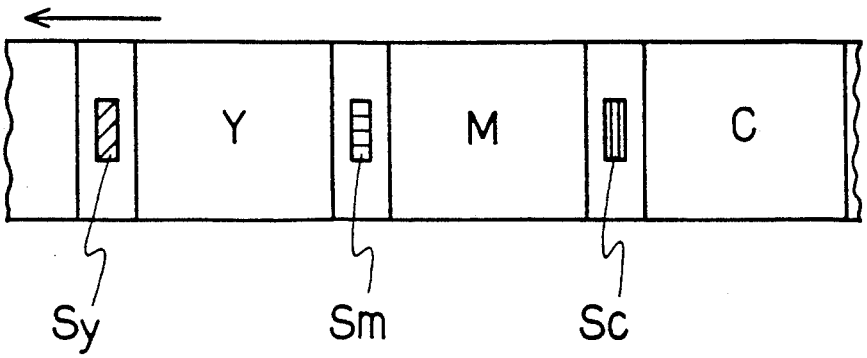
FIG. 10 PRIOR ART
FIG. 10 is a plan view for illustrating how detection marks are provided in the thermal transfer sheet shown in FIG. 9.

In selecting a desired ink layer of the thermal transfer ink sheet, detection marks corresponding to the ink layers for respective colors are previously printed on the ink sheet, and each detected by the sensor 31 for the selection. FIG. 10 shows a thermal transfer ink sheet on which such detection marks are printed. In this figure, symbols Sy, Sm and Sc denote detection marks corresponding to ink layers Y, M and C, respectively. The correspondence between the colors of the ink layers and the detection marks is shown in Table 2.

TABLE 2

| Color of ink layer | Detection mark |
|---|---|
| Y | Sy |
| M | Sm |
| C | Sc |

Color image formation with use of the thermal transfer color printer shown in FIG. 8 and the thermal transfer ink sheet shown in FIG. 10 is performed as follows.

When the yellow ink layer Y, for example, is to be transferred, the system part 22 feeds an instruction of transferring the color corresponding to the detection mark Sy to the control unit 29 in the printer part 28. In turn the control unit 29 causes the driving device 32 to feed the ink sheet 33 in the direction indicated by an arrow until the sensor 31 detects the detection mark Sy and, upon detection, to set the ink layer Y in the printing position, followed by notifying the system part 22 to the effect that the ink layer Y has been set in the predetermined position. In response thereto, the system part 22 feeds the yellow signal stored in the frame memory portion 26Y to the printer part 28, which, in response to the yellow signal, causes the thermal head 30 to operate so as to transfer the ink layer Y onto an image receptor 34, thereby forming an yellow image thereon. Magenta and cyan images are formed in a manner similar to the above.

Described next are specific conditions for the transfer in the order of C→M→Y with the aforesaid thermal transfer color printer in the present invention.

(1) The arrangement order of inks in the thermal transfer ink sheet is changed.

Figure 9:
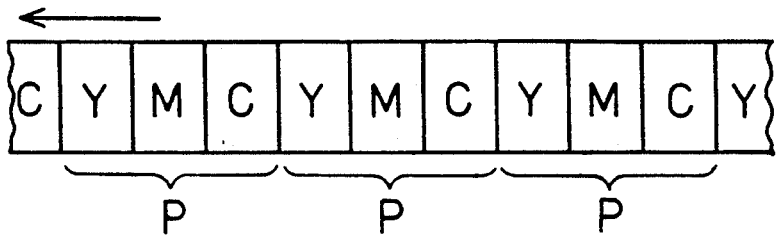
FIG. 9 PRIOR ART
FIG. 9 is a plan view for illustrating the arrangement order of transparent inks in a thermal transfer ink sheet which gives a color image in a conventional manner of superimposing the transparent inks Y, M and C.
Figure 11:
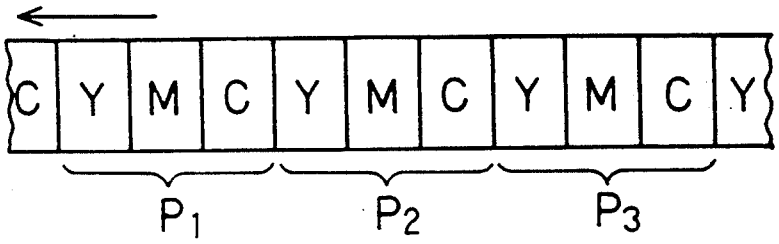
FIG. 11 is a plan view for illustrating the arrangement order of sublimation inks in the case where the arrangement order of the transparent inks shown in FIG. 9 is applied to the arrangement of the sublimation inks.

If a master is fabricated using the thermal transfer color printer which is left intact and designed to use a thermal transfer ink sheet of the type wherein the transparent inks Y, M and C are arranged on a single foundation as shown in FIG. 9, there is a need to use a thermal transfer ink sheet of the type shown in FIG. 11 wherein the sublimation inks are arranged in the same manner as in FIG. 9.

However, such a thermal transfer printer is adapted to feed the ink sheet in a single direction and, hence, not to move it in the direction opposite to such a feeding direction. Accordingly, when the yellow ink layer Y and the magenta ink layer M are transferred onto a master sheet in the order of M→Y for obtaining a red dyed image, the magenta ink layer M of pattern $P_1$ and the yellow ink layer of pattern $P_2$ should be sequentially transferred, thus necessitating two patterns. Likewise, two patterns are needed in each of the cases where the cyan ink layer C and the yellow ink layer Y are sequentially transferred to obtain a green dyed image and where the cyan ink layer C and the magenta ink layer M are sequentially transferred to obtain a blue dyed image. In the case of the transfer in the order of C→M→Y for obtaining a black dyed image, the cyan ink layer C of pattern $P_1$, the magenta ink layer M of pattern $P_2$ and the yellow ink layer Y of pattern $P_3$ should be sequentially transferred, which requires three patterns. Accordingly, in transferring in the order of C→M→Y it is not preferable to use the thermal transfer ink sheet in which the sublimation inks Y, M and C are arranged as in FIG. 11 because the amount of ink sheet to be consumed is increased.

Figure 3:
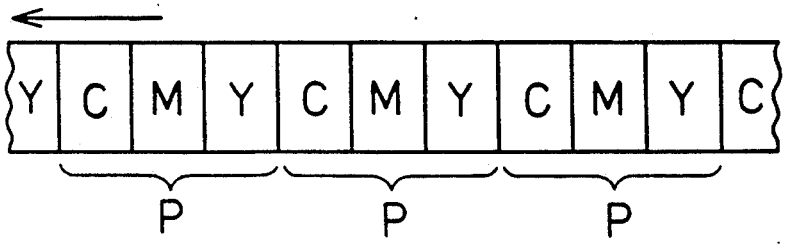
FIG. 3 is a plan view for illustrating the arrangement order of the sublimation inks Y, M and C in a thermal transfer ink sheet for use in an embodiment of the present invention.

For this reason, the present invention uses a thermal transfer ink sheet in which the sublimation inks Y, M and C are arranged in the order of transfer. That is, to be used in the present invention is a thermal transfer ink sheet in which the sublimation inks Y, M and C are arranged in the order of C, M and Y in the direction opposite to a sheet-feeding direction indicated by an arrow, and a pattern P consisting of this arrangement of C, M and Y is repeated many times, as shown in FIG. 3. With such arrangement the transfer of M→Y, C→Y, C→M or C→M→Y can be achieved using only one pattern.

(2) The ink sheet is not moved in the direction opposite to the sheet-feeding direction.

As described above, the mechanism of the printer would need to be modified to move the ink sheet reversely and, hence, the ink sheet is not moved reversely.

(3) The software of the system part 22 is modified to change the transfer order of colors.

That is, the program stored in the ROM 25 is modified so that the printer would transfer the colors in the orders as shown in Table 3 to reproduce the colors of the original document.

TABLE 3

| Color of original document | Colors to be transferred and order of transfer |
|---|---|
| Y | Y |
| M | M |
| C | C |
| R | M → Y |
| G | C → Y |
| B | C → M |
| BL | C →3 M → Y |

(4) The specification of the detection marks is not modified.

Figure 4:
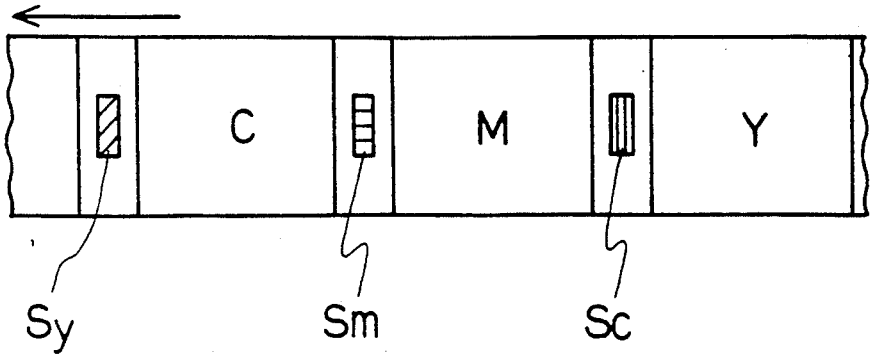
FIG. 4 is a plan view for illustrating how detection marks are provided in a thermal transfer ink sheet for use in an embodiment of the present invention.

To change the detection marks for the thermal transfer ink sheet, the form for printing the detection marks needs to be changed, which leads to a rise in cost. Therefore, as the form for the detection marks for use in the present invention the conventional one is used as it is. A thermal transfer ink sheet printed with such detection marks to be used in the present invention is as shown in FIG. 4. With such a thermal transfer ink sheet, upon detection of the mark Sy, the cyan ink layer C is selected, and upon detection of the mark Sc, the yellow ink layer Y is selected. When the detection mark Sm is detected, the magenta ink layer M is selected as with the conventional ink sheet. The correspondence between the respective colors of the ink layers and the detection marks is shown in Table 4.

TABLE 4

| Color of ink layer | Detection mark |
|---|---|
| C | Sy |
| M | Sm |
| Y | Sc |

(5) The software of the system part or the printer part is modified to change the correspondence between the colors to be transferred and the detection marks since the specification of the detection marks is not modified as described in the above item (4).

EMBODIMENT A (MODIFICATION OF THE SOFTWARE OF THE SYSTEM PART)

The program of the system part 22 is modified so that a signal indicative of the detection mark Sy would be fed to the printer part 28 when the color C is to be transferred and a signal indicative of the detection mark Sc would be fed thereto when the color Y is to be transferred. There is no modification for transferring the color M.

When the color C, for example, is to be transferred, the system part 22 instructs the printer part 28 to transfer the color corresponding to the detection mark Sy. Upon receipt of such an instruction, the printer part 28 searches for the cyan ink layer C marked with the detection mark Sy and transfers it to the master sheet.

Table 5 shows the correspondence among the colors to be transferred, the signals indicative of the detection marks which the system part feeds to the printer part, the detection marks which the printer part searches for and the ink layers selected.

TABLE 5

| System part | | Printer part | |
|---|---|---|---|
| Color to be transferred | Signal to be fed to printer part | Detection mark to be searched for | Color of selected ink layer |
| C | Sy | Sy | C |
| M | Sm | Sm | M |
| Y | Sc | Sc | Y |

EMBODIMENT B (MODIFICATION OF THE SOFTWARE OF THE PRINTER PART)

While the correspondence between the colors which the system part 22 intends to transfer and the signals indicative of the detection marks to be fed to the printer part 28 is as in the conventional manner, the control program of the printer part 28 is modified so that upon receipt of the signal indicative of the detection mark Sy, the printer part 28 would select the detection mark Sc and upon receipt of the signal indicative of the detection mark Sc, the printer part 28 would select the detection mark Sy. In the case of the detection mark Sm, there is no modification.

When the system part 22 intends to transfer, for example, the color C, upon receipt of an instruction to transfer the color corresponding to the detection mark Sc the printer part 22 converts the instructed detection mark Sc to the detection mark Sy and searches for and transfers the cyan ink layer C marked with the the mark Sy.

Table 6 shows the correspondence among the colors to be transferred, the signals indicative of the detection marks which the system part feeds to the printer part, the detection marks resulting from the conversion at the printer part and the colors of the ink layers selected.

TABLE 6

| System part | | Printer part | |
|---|---|---|---|
| Color to be transferred | Signal to be fed to printer part | Detection mark after conversion | Color of selected ink layer |
| C | Sc | Sy | C |
| M | Sm | Sm | M |
| Y | Sy | Sc | Y |

Figure 5:
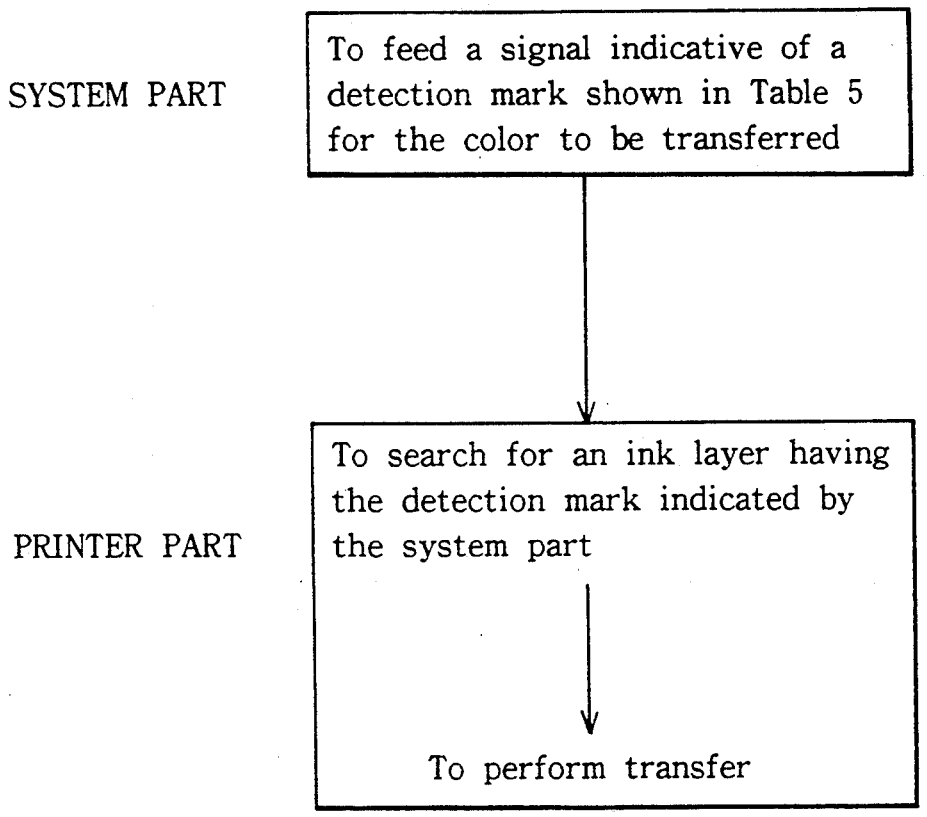
FIG. 5 is a flow chart of the operation of a thermal transfer printer in Embodiment A of the present invention.
Figure 6:
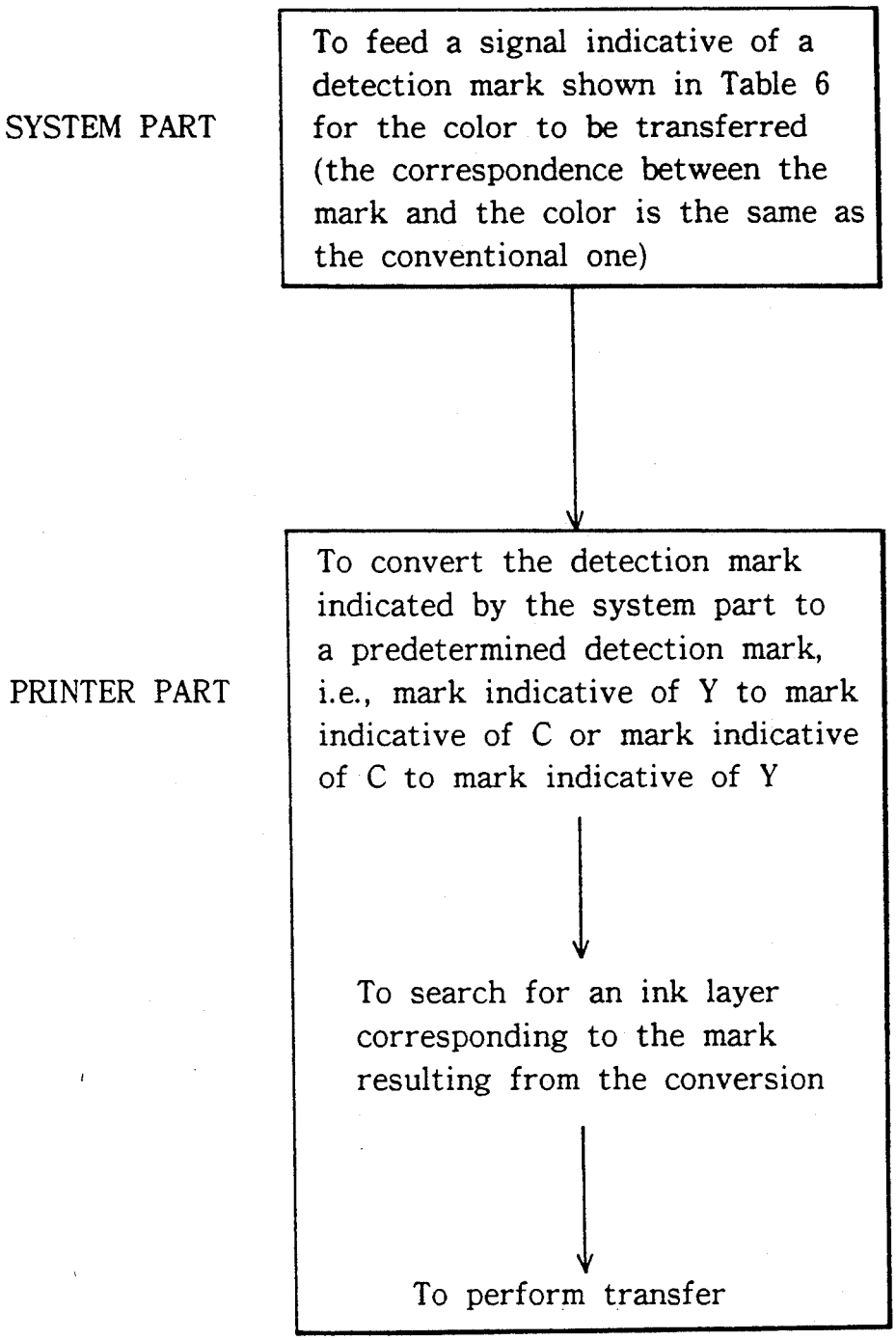
FIG. 6 is also a flow chart of the operation of a thermal transfer printer in Embodiment B of the present invention.

FIGS. 5 and 6 are flow charts in Embodiment A and Embodiment B, respectively. In both Embodiments A and B, the system part of the thermal transfer color printer is programmed to transfer in the order of C→M→Y while using the thermal transfer ink sheet having the arrangement pattern of inks and detection marks shown in FIG. 4.

To be described next is a process for fabricating a master using a thermal transfer color printer which is designed to use thermal transfer ink sheets in which the transparent inks Y, M and C are provided on separate foundations, respectively.

This thermal transfer color printer comprises in the printer part a yellow image formation part, magenta image formation part and cyan image formation part, each part having a thermal head. The printer is adapted to form a yellow image in the yellow image formation part with use of an ink sheet having the transparent ink Y, subsequently a magenta image on the yellow image in the magenta image formation part with use of an ink sheet having the transparent ink M and further a cyan image on the magenta image in the cyan image formation part with use of an ink sheet having the transparent ink C. In detail, the program stored in the system part of the printer causes signals for yellow, magenta and cyan respectively stored in the frame memory portions Y, M and C to be fed to the yellow image formation part, magenta image formation part and cyan image formation part in the order of Y→M→C. Therefore, the colors to be transferred and the order thereof to reproduce the colors of the original document are as same as those in Table 1.

Here, if the ink sheet having the transparent ink Y, the ink sheet having the transparent ink M and the ink having the transparent ink C are respectively replaced with an ink sheet having the sublimation ink C, one having the sublimation ink M and one having the sublimation ink Y to form a master, a cyan image is formed in response to the signal for yellow, while an yellow image in response to the signal for cyan.

Then, the software of the system part is modified so that the signals for cyan, magenta and yellow respectively stored in the frame memory portions C, M and Y would be respectively fed to the yellow image formation part, magenta image formation part and cyan image formation part in the order of C→M→Y.

As described above, the thermal transfer ink sheet for use in the present invention comprises the sublimation ink layers C, M and Y which are periodically provided on a single foundation in the aforesaid specific order or which are provided on separate foundations, respectively.

The sublimation ink is herein meant by a heat-meltable ink containing a sublimation dye, and any conventional sublimation ink is usable in the present invention.

The sublimation dye is herein meant by a dye which is transferable onto an image receptor by diffusion, sublimation (including volatilization) or a like phenomenon upon heating. Conventional sublimation dyes for use in the direct thermal transfer method, transfer printing method and a like method can be used without any particular limitation. Examples thereof are as follows:

Yellow sublimation dye

C.I. Disperse Yellow 3 (azobenzene dye), 23 (disazo dye), 7, 60 (pyrazoloneazo dye), 13 (benzanthrone dye), 54 (quinophthalone dye), 61 (methine dye), 82 (coumarin dye), 1, 5, 42, 141, 201, E, E-GRL.

Magenta sublimation dye

C.I. Disperse Red B, 1 (aminoazobenzene dye), 17, 4 (1-amino-4-hydroxyanthraquinone dye), 60, 135, 167, 210

C.I. Disperse Violet 26

C.I. Solvent Red 19, 155.

Cyan sublimation dye

C.I. Disperse Blue 14, 26 (4,8-diaminoanthraquinone dye), 3, 24, 56, 20 (naphthoquinone dye), 106

C.I. Solvent Blue 36, 63, 78, 105, 112

C.I. Disperse Violet 28 (1,4-diaminoanthraquinone dye).

These sublimation dyes for each color may be used singly or in admixture. Suitable sublimation dyes are those having a heat-transfer temperature of 60° C. or above.

The vehicle of the heat-meltable ink is composed of a wax substance or a mixture of a wax substance and a heat-meltable resin, and optionally an oily substance.

Examples of the wax substance includes natural waxes such as haze wax, bees wax, lanolin, carnauba wax, candelilla wax, montan wax and ceresine wax; petroleum waxes such as paraffin wax and microcrystalline wax; synthetic waxes such as oxidized wax, ester wax, low molecular weight polyethylene and Fischer-Tropsch wax; higher fatty acids such as lauric acid, myristic acid, palmitic acid, stearic acid and behenic acid; higher aliphatic alcohols such as stearyl alcohol and behenyl alcohol; esters such as higher fatty acid monoglycerides, sucrose fatty acid esters and sorbitan fatty acid esters; and amides such as oleic amide. These wax substances may be used singly or in admixture. Preferred wax substances have a melting point of 50° to 100° C.

Preferable as the heat-meltable resin are those having a compatibility with the wax substances. Examples of the heat-meltable resin includes xylene resin, coumarone-indene resin, styrene resin, ethylene-vinyl acetate copolymer resin, ethylene-butadiene copolymer resin, acrylic acid ester resin, polyamide resin, polyester resin and polyurethane resin. These resins may be used singly or in admixture. Preferred heat-meltable resins are those having a melting or softening temperature of 40° to 160° C. Examples of the oily substance are vegetable oils such as rapeseed oil and castor oil, mineral oils such as motor oil and spindle oil, and plasticizers such as dioctyl phthalate, dibutyl phthalate and tricresyl phosphate. A surface active agent may be added to the heat-meltable ink to improve the dispersibility of the sublimation dye. Examples of the surface active agent are sorbitan fatty acid ester, polyoxyethylene alkylphenyl ether and phosphoric acid alkyl ester.

The content of the sublimation dye in the heat-meltable ink layer is preferably from 5 to 70% (% by weight, hereinafter the same), especially from 20 to 45%. The vehicle may be composed of the wax substance alone. However, from the viewpoint of improving the application property, etc., it is preferable to use a heat-meltable resin in combination. When the heat-meltable resin is used in combination, the amount of the heat-meltable resin is preferably from 20 to 100 parts (parts by weight, hereinafter the same), especially from 40 to 80 parts, per 100 parts of the wax substance. When the amount of the resin is less than the above range, the effect of improving the application property is not exhibited, and in the case that the master sheet is porous, the heating time in the transfer printing step tends to become longer because the ink permeates into the sheet. When the amount of the resin is more than the above range, an unwanted transfer of the ink layer which means the phenomenon that the ink is peeled off in an larger area including not only the heated portion but also the circumference thereof, occurs and the reproducibility of ink dot becomes poor, which results in a failure to obtain a desired gradation.

The heat-meltable ink layer preferably has a melting point of 50° to 100° C. and a viscosity of 300 to $5\times10^5$ cP at 90° C. (value measured with a rheometer made by Rheology Co., Ltd., hereinafter the same). When the melting point of the ink layer is below the above range, the storage stability of the ink sheet becomes poor. When the melting point is higher than the above range, the melt-transferability becomes poor. When the viscosity at 90° C. is smaller than the above range, the strength of the ink layer is decreased so that the ink image on the master sheet tends to be smeared. When the viscosity is larger than the above range, the heat-transferability becomes poor.

The thickness of the heat-meltable ink layer is preferably from 0.5 to 5 μm. When the thickness is smaller than the above range, the density of the obtained dyed image is too low. When the thickness is larger than the above range, the transfer sensitivity is poor, the abrasion resistance of the ink image on the master sheet is poor or there occurs the phenomenon that the ink layer falls off in the form of flakes.

The sublimation ink layer can be formed by applying the aforesaid ink composition in the form of a solvent solution or a dispersion, or by hot-melt coating of the composition as it is. The formation of the sublimation ink layer is preferably conducted at a temperature lower than the transfer temperature of the sublimation dye.

Favorable as the foundation are heat-resistant plastic films such as polyester film, nylon film, cellulose triacetate film, polycarbonate film and polyimide film, and high density papers such as glassine paper and condenser paper. The thickness of the foundation is preferably from 2 to 10 μm.

In the thermal transfer ink sheet in which the sublimation ink layers for respective colors are arranged on a single foundation, the detection marks are provided for identifying the colors of the ink layers. The detection marks each may be located in a space between the ink layers or in a margin which may be provided in one end or opposite ends along the longitude of the ink sheet. The detection marks in an appropriate shape may be printed with an appropriate ink depending on the type of the detection means, for example, of the type based on transmission density, reflection density or transmittance.

Materials similar to those used as the foundation can be used as the master sheet. Generally, however, plain papers are preferably used. Plain papers having a wide range of smoothness, including a good smoothness (e.g., Bekk smoothness: about 1,000 seconds) and a very poor smoothness (e.g., Bekk smoothness: about 50 seconds), can be used.

As the image receptor, any material capable of being dyed with such sublimation dyes as mentioned above can be used without any particular limitation. Generally, however, woven or nonwoven fabrics of fibers can be preferably used. Examples of the fibers are polyester fibers, polyamide fibers, acrylic fibers and nylon fibers. It is needless to say that plastic films or sheets can be used therefor.

In the transfer printing method according to the present invention, a master is fabricated by transferring the sublimation inks onto the master sheet in the order of C→M→Y with use of the thermal transfer printer, as described above. As the heating means used in the transfer printing step for transferring the sublimation dyes, an iron, hot plate, etc. other than the aforesaid hot press can be used. The heating temperature and time varies depending on the kind of the sublimation dye and other conditions. Generally, however, the heating temperature is suitably selected from the range of not lower than the heat-transfer temperature of the sublimation dye used and below the temperature at which the heat shrinking of the image receptor and master sheet used takes place, and the heating time is suitably selected from the range of 5 seconds to 2 minutes. When the heating temperature is from about 180° C. to about 220° C., a clear dyed image can be obtained in a short heating time of about 5 to about 30 seconds.

In the present invention it is necessary to provide plural gradations for each of yellow, magenta and cyan in order to obtain intermediate colors other than yellow, magenta, cyan, green, red, blue and black. Such a color with gradations can be obtained by an area modulation method wherein one picture element is composed of M×N dot matrix where M and N are, usually, independently an integer of 2 to 8, and the number of ink dots included in the dot matrix is varied.

The present invention will be more fully described by way of Example. It is to be understood that the present invention is not limited to the Example, and various changes and modifications may be made in the invention without departing from the spirit and scope thereof.

EXAMPLE

On a continuous polyester film having a thickness of 6 μm and a width of 246 mm were applied and dried ink solutions for yellow, magenta and cyan of respective formulae shown in Table 7 to give a thermal transfer ink sheet having an arrangement of ink layers as shown in FIG. 4. Each of the ink layers had a length of 270 mm along the longitude of the foundation film. The physical properties of each ink layer are also shown in Table 7.

TABLE 7

| | Yellow | Magenta | Cyan |
|---|---|---|---|
| Formula of ink (part) | | | |
| Yellow-A-G*[1] | 6.0 | — | — |
| Red-130*[2] | — | 8.3 | — |
| Blue-F-R*[3] | — | — | 9.8 |
| Carnauba wax | 6.4 | 5.0 | 4.3 |

TABLE 7-continued

| | Yellow | Magenta | Cyan |
|---|---|---|---|
| Paraffin wax | 5.6 | 4.7 | 3.6 |
| EVA*4 | 6.0 | 6.0 | 6.2 |
| Toluene | 76.0 | 76.0 | 76.1 |
| Physical properties of ink layer | | | |
| Thickness (μm) | 1 | 1 | 1 |
| Content of dye (%) | 25 | 35 | 41 |
| Melting point (°C.) | 73 | 73 | 73 |

*1Disperse Yellow 54 made by Nippon Kayaku Co., Ltd.
*2Disperse dye made by Nippon Kayaku Co., Ltd.
*3Solvent Blue 105 made by Nippon Kayaku Co., Ltd.
*4Ethylene-vinyl acetate copolymer (softening point: 135° C.)

With use of the thus obtained thermal transfer ink sheet, a master was fabricated by selectively transferring the cyan, magenta and yellow ink layers in this order onto a master sheet to be specified below by means of a thermal transfer color printer also to be specified below. The resulting master was placed on a polyester fabric, then hot-pressed against the fabric with a hot press as shown in FIG. 2 under the conditions noted below, to form a gray dyed image thereon. In this case one picture element in the master was composed of 8×8 dot matrix so as to obtain 64 gradations for each color and the dot matrix for each color was made to have a checkered pattern on a two-dot basis.

Printer: Color Mate PS made by NEC Corporation, of which the program was modified so as to perform transfer in the order of C→M→Y.

Master sheet:

Plain paper having a thickness of 70 μm and a Bekk smoothness of 360 seconds.

Hot press:

Heating temperature: 200° C.

Heating time: 15 seconds

Pressure: 2 kg/cm$^2$.

Besides the thus obtained gray dyed image, solid dyed images of respective colors were formed by fabricating masters respectively having solid printed images of yellow, magenta and cyan and, in the same manner as above, pressing each of the masters against a polyester fabric with the hot press. These solid dyed images were measured for optical reflection density (OD value) with a densitometer, Macbeth RD-914, made by Macbeth. The results are shown in Table 8.

COMPARATIVE EXAMPLE

On a continuous polyester film having a thickness of 6 μm and a width of 246 mm was applied and dried ink solutions for yellow, magenta and cyan of the formulae shown in Table 7 to form a thermal transfer ink sheet having an arrangement of ink layers as shown in FIG. 10. Each of the ink layers had a length of 270 mm along the longitude of the foundation film.

A gray dyed image was formed on a polyester fabric in the same manner as in Example except that a master was formed by selectively transferring the ink layers in the order of Y→M→C using the thus obtained thermal transfer ink sheet with Color Mate PS (which was not modified) as a printer.

As in Example, besides the gray dyed image, solid dyed images of yellow, magenta and cyan were separately formed, and then measured for their OD values.

The results are as shown in Table 8.

TABLE 8

| | OD value | | |
|---|---|---|---|
| | Y | M | C |
| Example | 1.40 | 1.44 | 1.40 |
| Comparative Example | 1.40 | 1.44 | 1.40 |

Next, a reference gray color and the gray dyed images obtained in Example and Comparative Example were measured for spectral reflectance under the following conditions. From the data thus obtained, tristimulus values XYZ were found, and from the values found, chromaticities a* and b* were calculated (according to JIS Z 8730). Then, difference Δa* or Δb* between the chromaticity a* or b* of the reference gray color and that of the gray dyed image obtained in Example of Comparative Example was calculated.

Light source: D65

Field of view: 2 degrees

Equipment for optical measurement: MS-2020 PLUS, a color conditioning system made by Macbeth.

The above reference gray color was obtained as follows. A thermal transfer ink sheet was formed such that the OD values of solid dyed images (on polyester fabric) to be derived from this ink sheet would assume 1.15, 1.25 and 1.30, respectively, by varying the respective coating amounts of the ink solutions for yellow, magenta and cyan shown in Table 7. A master was fabricated in the same manner as in Example except for using the thus obtained thermal transfer ink sheet and transferring the colors in the order of Y→M→C, and then a gray dyed image was formed on a polyester fabric. It should be noted that such a thermal transfer ink sheet was formed only for obtaining the reference gray color, and with this ink sheet the OD values of the solid dyed images of yellow and magenta were as low as 1.15 and 1.25, respectively, resulting in failure to obtain high density for yellow or magenta.

The results of the above are shown in Table 9.

TABLE 9

| | Reference | Example | Comp. Ex. |
|---|---|---|---|
| L* | 49.59 | 42.92 | 43.96 |
| a* | 0.74 | 2.11 | 3.08 |
| b* | −4.65 | −4.41 | 4.42 |
| C* | 4.71 | 4.89 | 5.39 |
| H* | 260.96 | 295.59 | 55.15 |
| ΔL* | — | −6.67 | −5.63 |
| Δa* | — | 2.85 | 3.82 |
| Δb* | — | 0.24 | 9.08 |
| ΔC* | — | 0.18 | 0.68 |
| ΔH* | — | −2.86 | −9.82 |
| ΔE* | — | 7.26 | 11.34 |

Figure 7:
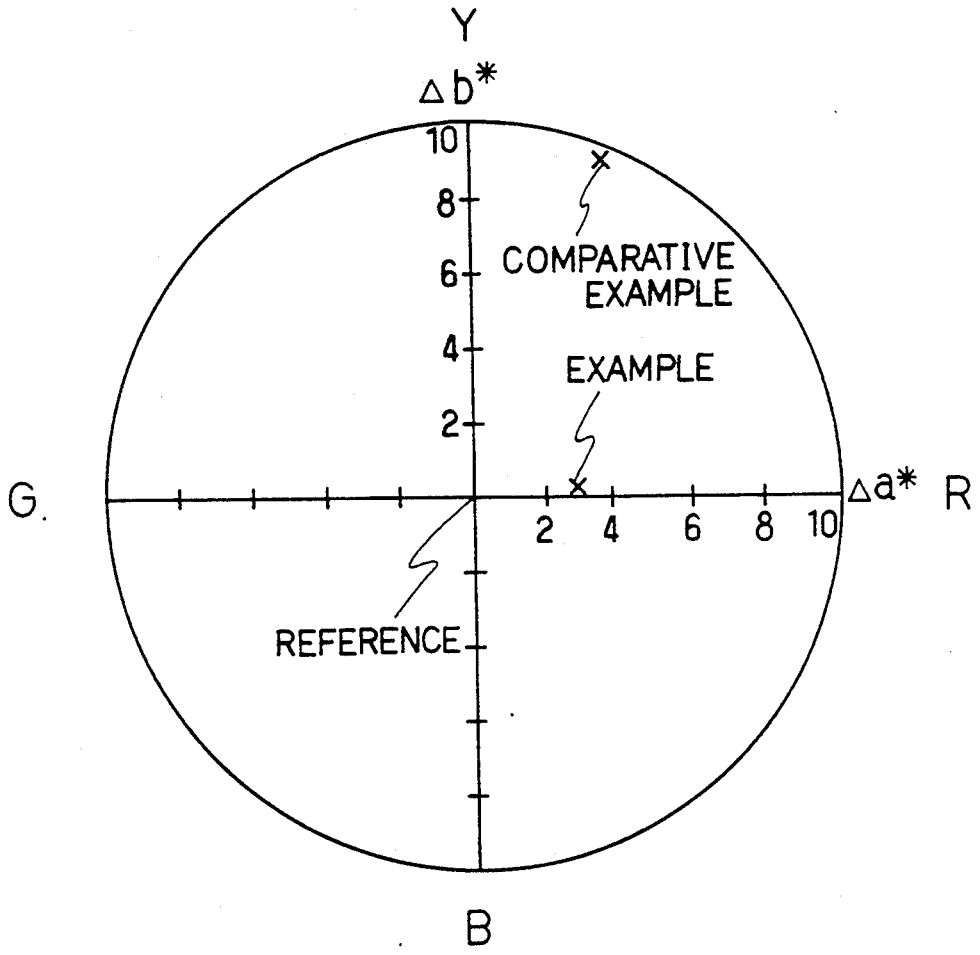
FIG. 7 is a graph in which $\Delta a^*$ and $\Delta b^*$ found for gray dyed images obtained in Example and Comparative Example are plotted in the $a^*b^*$ face of the color space of CIE 1976 ($L^*a^*b^*$) system.

A graph in which Δa* and Δb* found for the gray dyed images respectively obtained in Example and Comparative Example are plotted in a*b* face of a color space of CIE 1976 (L*a*b*) system is shown in FIG. 7.

As is apparent from Table 9 and FIG. 7, the gray dyed image in Comparative Example is strongly tinged with yellow, while in contrast the gray dyed image in Example exhibits a gray color very near the reference gray color.

As has been described, according to the present invention a dyed image with good color reproducibility, especially for an achromatic color can be obtained by using a master fabricated by transferring sublimation inks in the order of C→M→Y onto a master sheet.

In addition to the materials and ingredients used in the Example, other materials and ingredients can be used in the Example as set forth in the specification to obtain substantially the same results.

What is claimed is:

1. A transfer printing method comprising the steps of:

providing a thermal transfer ink sheet wherein a heat-meltable ink Y containing a sublimation dye for yellow, a heat-meltable ink M containing a sublimation dye for magenta and a heat-meltable ink C containing a sublimation dye for cyan are applied on a single foundation in the order of ink C, ink M and ink Y in a direction opposite to a direction in which said thermal transfer ink sheet is to be fed, selectively melt-transferring at least two of the inks Y, M and C onto a master sheet in the order of ink C, ink M and ink Y to form a master image in which at least two of the respective images of the inks Y, M and C are superimposed one on the other; and transferring the sublimation dyes contained in the superimposed images onto an image receptor; wherein in forming said master image on said master sheet, a thermal transfer printer is used which is constructed to use a thermal transfer ink sheet wherein a yellow ink Y, a magenta ink M and a cyan ink C are periodically arranged in this order on a single foundation in a direction opposite to a feeding direction of the thermal transfer ink sheet and detection marks Sy, Sm and Sc are provided for the inks Y, M and C, respectively, and which selects the inks for desired colors by detecting the detection marks with a detection means when the thermal transfer ink sheet is moved in the feeding direction; and wherein in the thermal transfer ink sheet detection marks Sy, Sm and Sc are provided for said inks C, M and Y, respectively, and said inks C, M and Y are transferred onto said master sheet in this order by selecting and transferring said sublimation ink C upon detection of the detection mark Sy, said sublimation ink M upon detection of the detection mark Sm, and said sublimation ink Y upon detection of the detection mark Sc, by the detection means.

* * * * *